US005237975A

United States Patent [19]

Betki et al.

[11] Patent Number: 5,237,975

[45] Date of Patent: Aug. 24, 1993

[54] RETURNLESS FUEL DELIVERY SYSTEM

[75] Inventors: Randall A. Betki, Inkster; Thomas E. Wiseman; Brian C. Prodin, both of Ypsilanti; Stephen T. Kempfer, Canton; Michael R. Tinskey, Ypsilanti, all of Mich.

[73] Assignee: Ford Motor Company, Dearborn, Mich.

[21] Appl. No.: 966,922

[22] Filed: Oct. 27, 1992

[51] Int. Cl.[5] ..... F02M 37/04

[52] U.S. Cl. ..... 123/497; 123/456

[58] Field of Search ..... 123/497, 499, 456, 381, 123/463, 464; 417/45

[56] References Cited

U.S. PATENT DOCUMENTS

| | | | |
|---|---|---|---|
| 3,822,677 | 7/1974 | Reddy | 123/32 EA |
| 3,827,409 | 8/1974 | O'Neill | 123/32 EA |
| 3,913,547 | 10/1975 | Wentworth et al. | 123/497 |
| 3,935,851 | 2/1976 | Wright et al. | 123/139 E |
| 3,949,713 | 4/1976 | Rivere | 123/32 EA |
| 3,949,714 | 4/1976 | Mitchell | 123/32 EA |
| 3,967,598 | 7/1976 | Rachel | 123/497 |
| 4,048,964 | 9/1977 | Kissel | 123/32 ED |
| 4,096,830 | 6/1978 | Long | 123/32 EA |
| 4,260,333 | 4/1981 | Schillinger | 417/45 |
| 4,326,487 | 4/1982 | Maisch et al. | 123/453 |
| 4,392,469 | 7/1983 | Wessel | 123/387 |
| 4,404,944 | 9/1983 | Yamazaki et al. | 123/458 |
| 4,419,976 | 12/1983 | Hosaka | 123/458 |
| 4,497,300 | 2/1985 | Maruyama et al. | 123/463 |
| 4,498,334 | 2/1985 | Riesenberg | 73/113 |
| 4,522,174 | 6/1985 | Babitzka et al. | 123/300 |
| 4,546,745 | 10/1985 | Brotherston | 123/387 |
| 4,565,173 | 1/1986 | Oshiage et al. | 123/458 |
| 4,635,603 | 1/1987 | Hara | 123/383 |
| 4,635,606 | 1/1987 | Koike et al. | 123/463 |
| 4,649,884 | 3/1987 | Tuckey | 123/457 |
| 4,660,531 | 4/1987 | Lauterbach et al. | 123/456 |
| 4,728,264 | 3/1988 | Tuckey | 417/44 |
| 4,756,291 | 7/1988 | Cummins et al. | 123/497 |
| 4,763,626 | 8/1988 | Staerzl | 123/381 |
| 4,774,923 | 10/1988 | Hayashi | 123/381 |
| 4,777,921 | 10/1988 | Miyaki et al. | 123/456 |
| 4,789,308 | 12/1988 | Tuckey | 417/44 |
| 4,791,905 | 12/1988 | Furuta et al. | 123/497 |
| 4,798,308 | 1/1989 | Nelson | 220/445 |
| 4,800,859 | 1/1989 | Sagisaka et al. | 123/497 |
| 4,811,710 | 3/1989 | Schmitt et al. | 123/359 |
| 4,827,897 | 5/1989 | Yamada et al. | 123/497 |
| 4,829,964 | 5/1989 | Asayama | 123/463 |
| 4,836,157 | 6/1989 | Miller | 123/187.5 R |
| 4,883,039 | 11/1989 | Toshimitsu et al. | 123/463 |
| 4,926,829 | 5/1990 | Tuckey | 123/497 |
| 4,940,034 | 7/1990 | Heim et al. | 123/497 |
| 4,940,037 | 7/1990 | Eckert | 123/497 |
| 4,951,636 | 8/1990 | Tuckey et al. | 123/497 |
| 4,955,345 | 9/1990 | Brown et al. | 123/381 |
| 4,982,331 | 1/1991 | Miyazaki | 364/431.04 |
| 5,060,619 | 10/1991 | Sakurai et al. | 123/381 |
| 5,133,323 | 7/1992 | Trousch | 123/497 |
| 5,148,792 | 9/1992 | Tuckey | 123/497 |

*Primary Examiner*—E. Rollins Cross
*Assistant Examiner*—Thomas Maulis
*Attorney, Agent, or Firm*—Roger L. May; Peter Abolins

[57] ABSTRACT

A returnless fuel delivery control system is disclosed which regulates fuel rail pressure at the level needed for precise control of fuel mass flow to fuel injectors at both normal and elevated engine temperatures. This regulation is accomplished by precisely controlling the speed of the fuel pump motor as a function of the projected fuel demand based on engine RPM and injector pulse width. The projection is modified as a function of differential pressure error. The differential pressure error responds to a fuel temperature strategy which increases the target differential pressure as a function of fuel temperature.

10 Claims, 4 Drawing Sheets

RETURNLESS FUEL DELIVERY SYSTEM

TECHNICAL FIELD

This invention relates to a fuel delivery system for fuel injected internal combustion engines, and more particularly to a fuel delivery system which eliminates the conventional pressure regulator and fuel return line and the attendant fuel tank vapor formation problems, by precisely controlling the speed of the fuel pump to achieve an optimum intake manifold/fuel rail differential pressure under both normal and high fuel temperature conditions.

BACKGROUND ART

A conventional fuel delivery system includes a fuel tank with a fuel pump located therein for supplying fuel to a plurality of fuel injectors located in a fuel rail. Each fuel injector is controlled by an electronic control unit (ECU) which is responsive to various engine operating conditions to provide a variable pulse width control signal to each injector to meet the fuel demand of the engine. A pressure regulator is interposed between the pump and the rail and is designed to maintain the fuel pressure in the rail at approximately 40 psi greater than engine intake manifold vacuum.

The fuel pump runs at a constant speed and may deliver, for example, 90 liters per hour. Under idle conditions the engine needs only about 3 liters per hour, so in that case 87 liters per hour is returned to the fuel tank from the pressure regulator through return lines. There are a number of problems associated with return of fuel from the high temperature engine area to the relatively low pressure and low temperature which exist in the fuel tank. Because of the high temperature and pressure of the fuel being returned, substantial amounts of fuel vapor are generated and exist in the tank which must be vented to the atmosphere which may in turn create environmental problems.

SUMMARY OF THE INVENTION

In view of the above, it is an object of the present invention to provide a fuel delivery system which avoids the need for a pressure regulator and fuel tank return line, while compensating for above normal engine temperature by raising the fuel pressure at the fuel rail by increasing the speed of the fuel pump.

It is another object of the present invention to improve performance of an engine provided with an injection type fuel delivery system while lowering evaporative emissions.

It is another object of the present invention to provide a method of controlling the speed of a fuel pump in order to provide a compensating fuel pressure increase to offset the reduction in mass fuel flow which normally accompanies high engine temperature.

It is another object of the present invention to increase the life of the vehicle fuel pump by reducing the electrical load on the pump motor.

It is another object of the present invention to provide a fuel delivery system that compares fuel mass flow prediction or demand with the fuel mass flow actually supplied to the injectors in order to obtain an indication of fuel leakage.

In accordance with the present invention a fuel delivery control system is provided which regulates fuel rail pressure at the level needed for precise control of fuel flow at both normal and intermediate engine temperatures. This regulation is accomplished without resort to the usual differential pressure regulator with the attendant return line to the fuel tank. Since fuel is not recirculated, the fuel in the tank stays at approximately ambient temperature or as much as 20–30 degrees cooler in certain areas during the summer months. Also, since hot fuel is not returned to the tank, vapor reduction is very significant. Moreover, by precisely controlling the speed of the fuel pump motor to control pressure, pump noise is reduced and the effects of electrical system voltage variation of fuel pump operation is reduced.

BRIEF DESCRIPTION OF THE DRAWINGS

A more complete understanding of the present invention may be had from the following detailed description which should be read in conjunction with the drawings in which.

DETAILED DESCRIPTION OF PREFERRED EMBODIMENT

Figure 1:
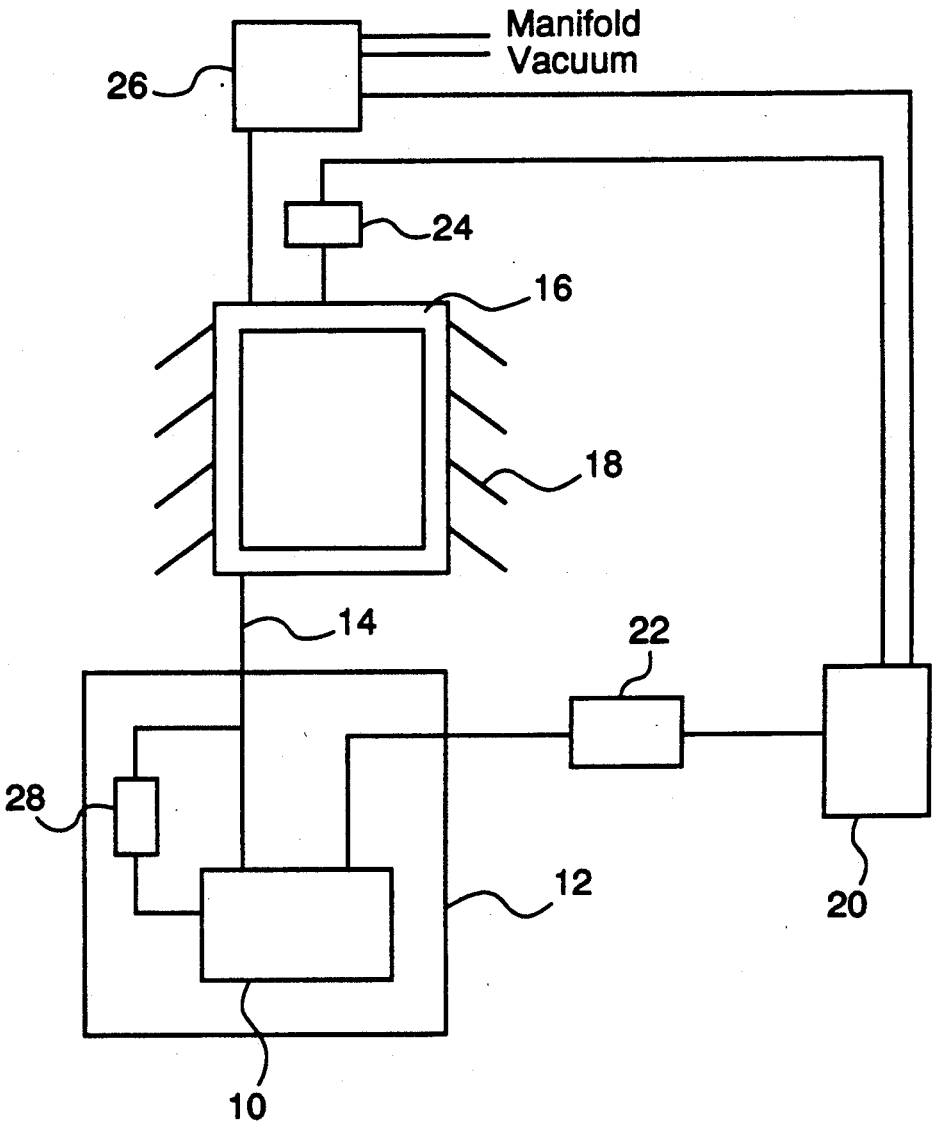
FIG. 1 is a block diagram of the invention.

Referring now to the drawings, and initially to FIG. 1, a fuel delivery system in accordance with the present invention is shown and includes a fuel pump generally designated 10 located within a fuel tank 12 of a vehicle. The pump 10 supplies fuel through a supply line 14 to a fuel rail 16 for distribution to a plurality of injectors 18. The speed of the pump 10 is controlled by an engine control module 20. The module 20 supplies control signals which are amplified and frequency multiplied by a power driver 22 and supplied to the pump 10. The module 20 receives a fuel temperature input from a fuel temperature sensor 24 as well as an input from a differential pressure sensor 26. The sensor 26 responds to intake manifold vacuum and to the pressure in the fuel rail 16 to provide the differential pressure signal to the module 20. The module 20 uses this information to determine the fuel pump voltage needed to provide the engine with optimum fuel pressure and fuel flow rate. A pressure relief valve 28 is positioned in parallel with a check valve which is in the fuel supply line 14. The parallel connected relief valve prevents excessive pressure in the fuel rail 16 during engine-off hot soaks. Also, the relief valve 28 assists in smoothing engine-running transient pressure fluctuations. Though not shown in the drawing it will be understood by those skilled in the art that the module 20 also controls the pulse width of a fuel injector signal applied to the injectors 18 in order to control the amount of fuel injected into the engine cylinders in accordance with a control algorithm. This signal is a variable frequency, variable pulse width signal that controls injector valve open time.

Figure 2:
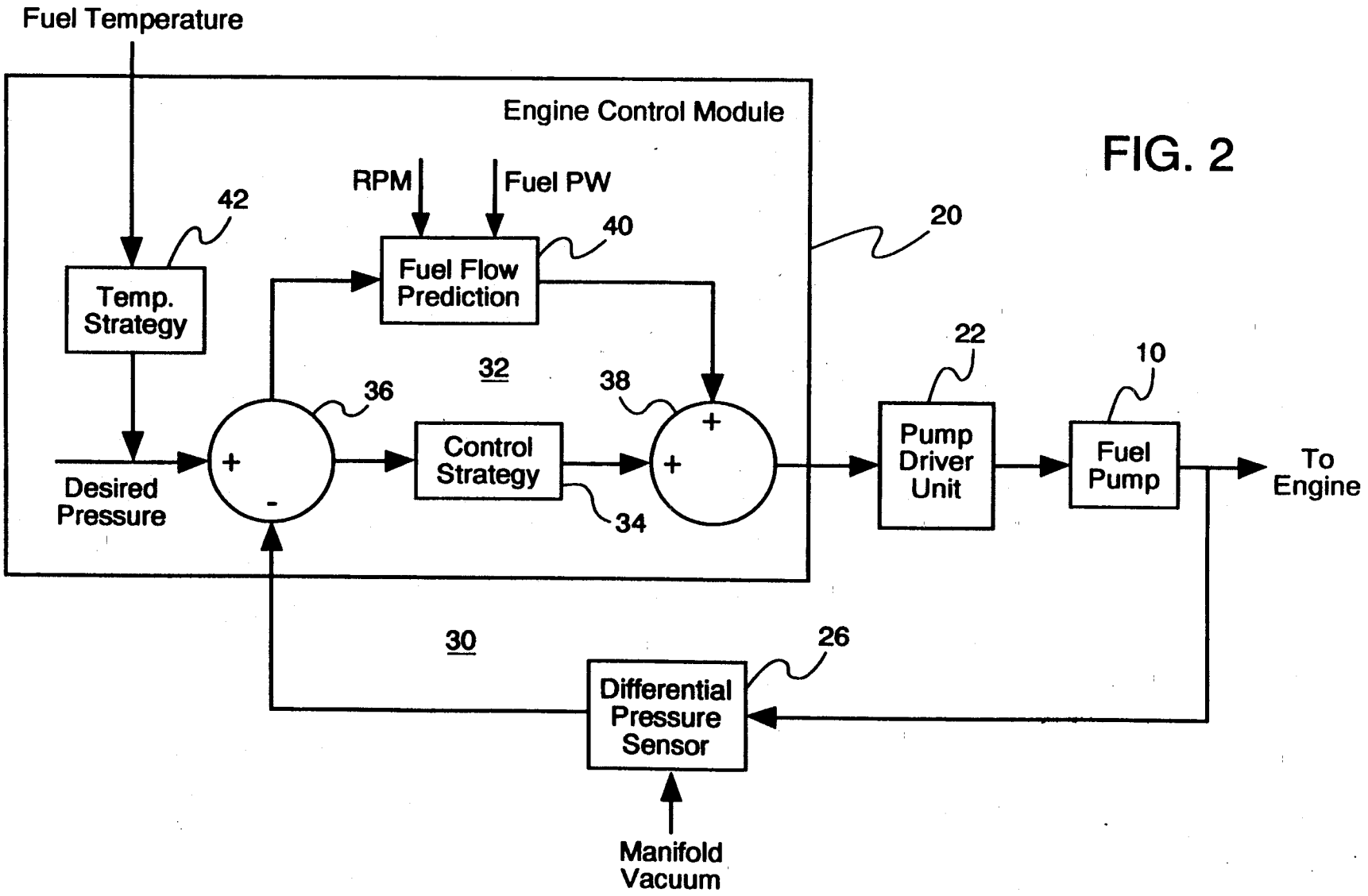
FIG. 2 is a control diagram showing the various control strategies used in the invention.

Referring now to FIG. 2, the module 20 generates a constant frequency pulse width modulated (PWM) fuel pump control signal in accordance with an overall control strategy which includes a Proportional-Integral-Derivative (PID) feedback loop generally designated 30 and a feedforward loop generally designated 32. The loop 30 includes a control strategy block 34 which responds to the error output of a comparator 36 which represents the difference between a desired differential pressure input and the actual differential pressure as input from the sensor 26. Under normal circumstances the desired pressure may be for example 40 psid. The output of the block 34 represents the time history of the error input and is combined in a summer 38 with the output of a fuel flow prediction block 40 to vary the duty cycle of the PWM signal to the pump 10 in a sense to reduce the error input to the block 34 toward zero and maintain a substantially constant 40 psid. Since the PID loop responds to differential pressure, a sudden change in manifold vacuum as would occurs for example if the driver requests full throttle, can produce substantial instability in the PID loop. The block 40 compensates for this instability. The block 40 utilizes engine RPM and injector pulse width (PW) to predict mass fuel flow. The variables are obtained by monitoring one of the fuel injector control lines. From these inputs defining a particular engine operating point, a look up table is accessed to provide an optimum duty cycle for the PWM control signal to the pump 10. The fuel flow prediction provides a very quick response to engine operating conditions which cannot be adequately controlled by the PID loop 30. The PID loop provides a fine tuning of the overall control strategy and compensates for pump and engine variability. The fuel flow prediction is also used as an indicator of gross fuel leaks in the delivery system as might occur during a broken supply line during an accident. The mass fuel flow prediction is compared with the fuel mass being supplied by the pump and if the prediction or demand is substantially less than the actual fuel mass being supplied then the pump is turned off.

While it is desirable to eliminate the return line to the fuel tank, doing so prevents the fuel from being used as a coolant. At idle, where fuel flow is low, the fuel in the rail is heated by convection from the engine and if the target fuel reaches its vapor point on the distillation curve it will vaporize causing less fuel to be delivered through the injectors for a given pulse width injector control signal. A temperature strategy block 42 is employed to compensate for this potential mass flow reduction. The block 42 responds to the output of the fuel temperature sensor 24 and modifies the desired pressure input to the comparator 40 as a function of the temperature of the fuel in the rail. Thus, as the fuel temperature increases the error signal to the PID control strategy block 34 resulting in an increase in the duty cycle of the control signal to the pump 10 which raises the fuel pressure in the rail 16 thus maintaining the mass flow through the injectors. The same amount of fuel is thus delivered to cylinders regardless of temperature change and without having to alter the pulse width of the fuel injector control signal. This permits the present invention to be added to a vehicle without modifying the injection pulse width control signal algorithm. The block 42 raises the input to the comparator 36 above 40 psi to compensate for higher than normal fuel temperature. Thus, the PID loop is primarily responsible for the increase in fuel pressure in response to temperature increases. Under low temperature conditions the speed of the pump 10 is primarily determined by the fuel flow prediction term of the block 40.

If the fuel flow prediction table is calibrated for the default desired differential pressure of 40 psi it will not produce an accurate prediction of fuel flow when the desired pressure is raised in response to increases in temperature. Since there is a square root relationship between pressure and mass fuel flow, this inaccuracy may be alleviated if desired by modifying the duty cycle prediction by a multiplication factor corresponding to the square root of the percentage increase in the desired pressure above the default 40 psi. resulting from implementation of the temperature strategy 42. Alternatively, a plurality of lookup tables associated with different differential pressure values may be employed and selectively accessed.

Figure 3:
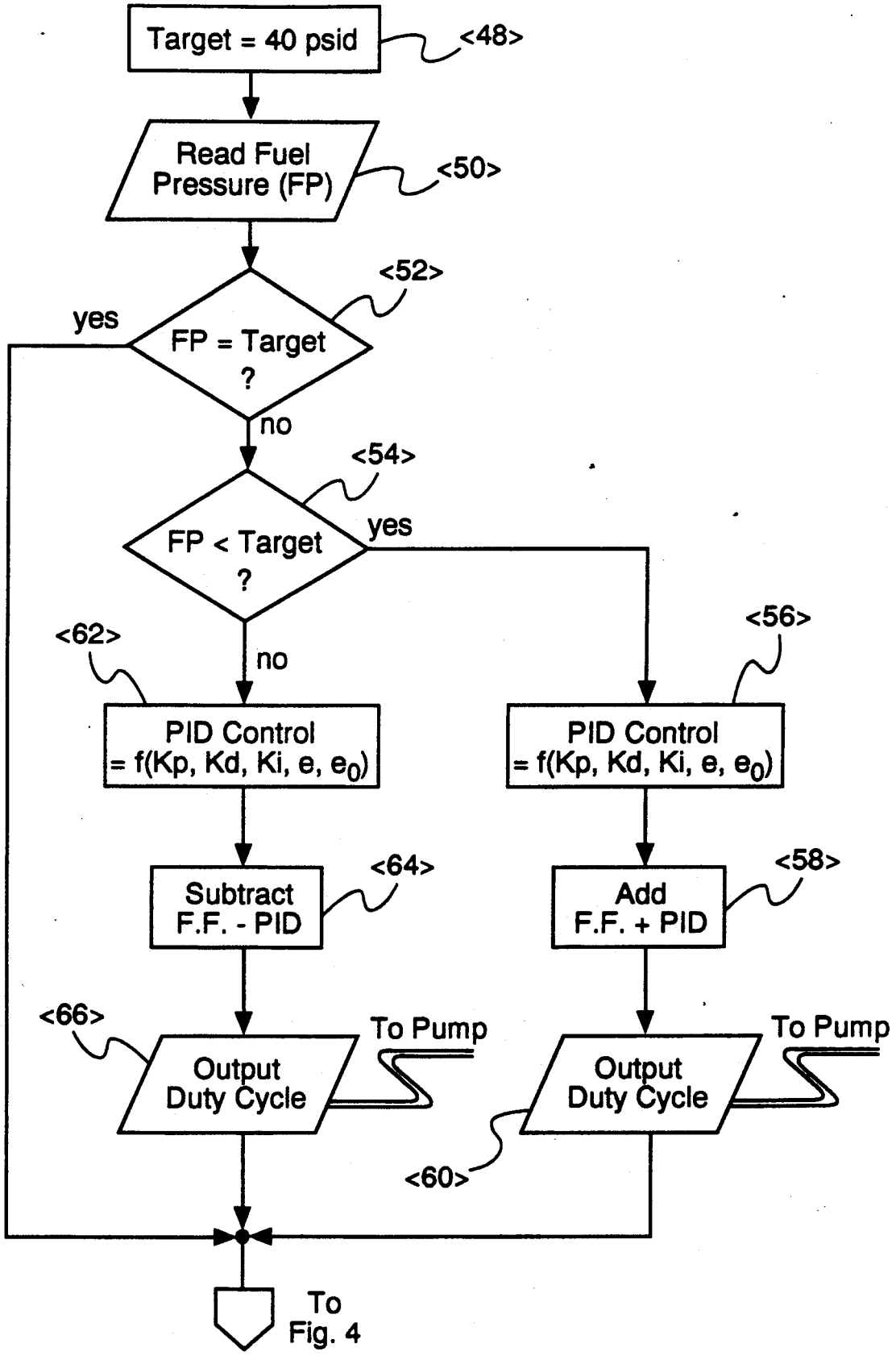
FIG. 3 is a flow chart of fuel control method of the present invention.

A flow chart of the duty cycle control program or algorithm as implemented on a microprocessor based control module such as the module 20 is shown in FIG. 3. The blocks in the flow chart are identified by numeral with angel brackets. The module 20 monitors <50> the differential pressure output of the sensor 26 and compared <52> the periodic readings to a target differential pressure <48> of for example 40 psid. If the pressure is less <54> than the target then the PID control strategy output <56> is added <58> to the FF term and the duty cycle of the fuel pump PWM control signal is increased <60> to raise the fuel pressure in the rail. On the other hand if the differential pressure is less than the target pressure the PID control strategy output <62> is subtracted <64> from the FF term and duty cycle of the fuel pump PWM control signal is decreased <66> to lower the fuel pressure in the rail. The gains implemented in the PID control strategy <62>, <56> are different because of the time lag associated with reducing the pressure in the rail.

Figure 4:
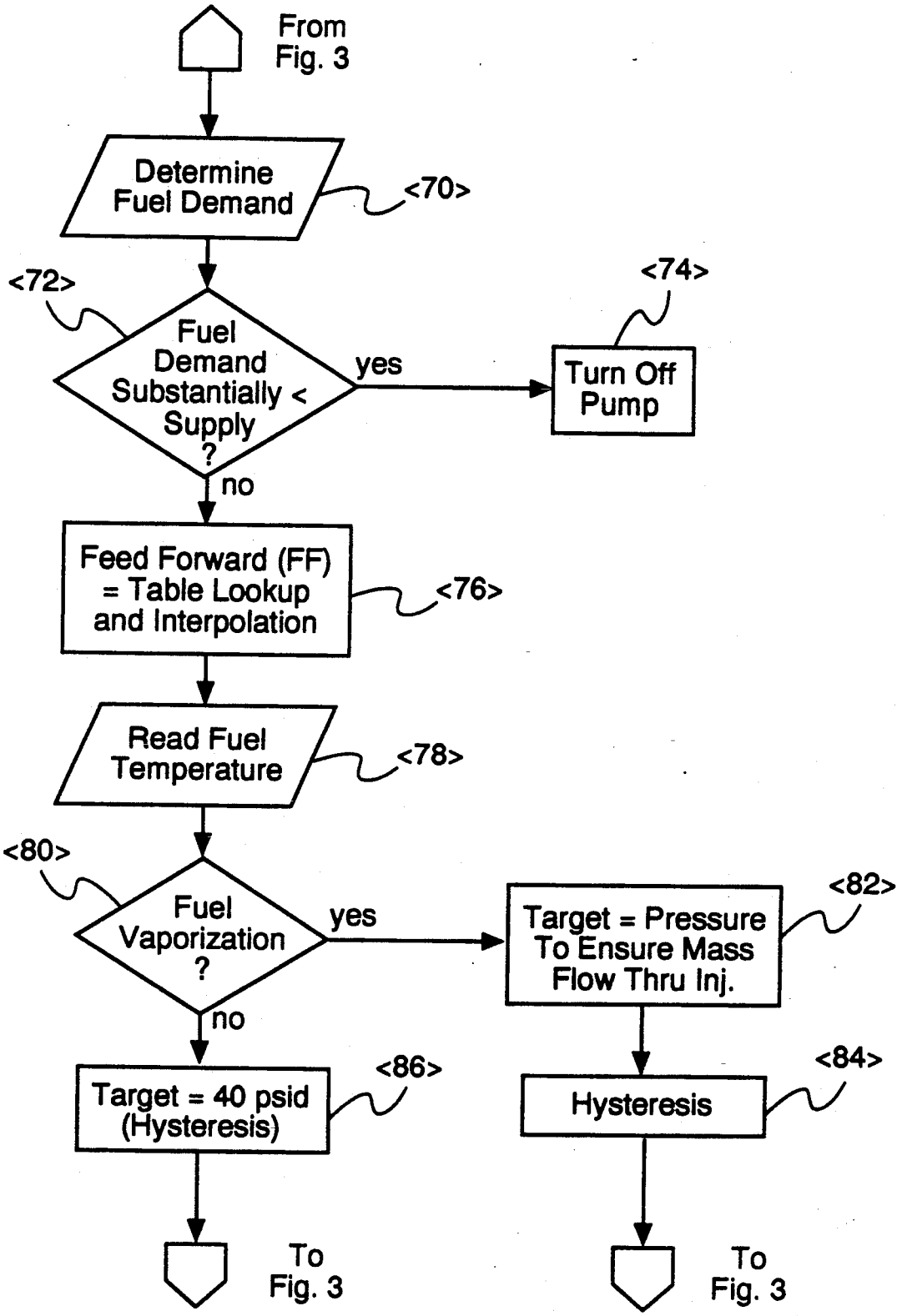
FIG. 4 is a flow chart of the fuel demand prediction routine and the temperature strategy.

With reference to FIG. 4, the feed forward routine which provides the term used in the main routine at <58> and <64> of FIG. 3 is shown. As previously stated, an indication of the present fuel demand <70> of the engine is obtained by monitoring one of the fuel injector control signal to obtain the pulse width (PW) and period of the signal. If the fuel demand is substantially less than fuel supply <72> the pump is turned off <74>. Otherwise, from the period or frequency of the fuel injector control signal, engine RPM is directly obtained. The feed forward routine <76> is basically a look up table routine which includes interpolation where necessary. From two inputs, RPM and PW, a two dimensional lookup table is entered and provides a best estimate of the duty cycle of the pump PWM control signal needed to meet the fuel demand. This best estimate of duty cycle is preferably in terms of a specific number of computer clock cycles, which is proportional to pump duty cycle.

The temperature strategy routine used to determined the target differential pressure used in the main routine of FIG. 3 is shown in FIG. 4 as being executed following the fuel demand calculation. It will be understood however that the routines for calculating target pressure as well as fuel demand may be called at the times shown in FIG. 3 namely the Target block and blocks <58>, <60>. The fuel temperature in the rail is read <78> and if the temperature is above a predetermined value at which fuel vaporization is likely to take place <80>, the target differential fuel rail pressure is increased <82> from a nominal 40 psi to a value that will cause the PID loop to increase the duty cycle of the pump to ensure the desired fuel mass flow through the injectors. Hysteresis <84> is added so that the temperature/pressure relationship follows a different path when the temperature is increasing above normal than when decreasing toward normal. In other words the pressure returns to the nominal 40 psi in a slightly different rate over the last 10 degrees on either side of the predetermined fuel vaporization temperature so that the pressure reaches 40 psi at a lower temperature. This prevents chattering in the case where temperature begins to exceed the set point of fuel vaporization and prevents the system from being "fooled" by the cooling effect of for example an open throttle condition where the instantaneous temperature of the fuel might drop <86> the instantaneous temperature below the set point.

While the best mode for carrying out the invention has been described in detail, those familiar with the art to which this invention relates will recognize various alternative designs and embodiments for practicing the invention as defined by the following claims.

We claim:

1. A returnless fuel delivery system comprising a variable speed fuel pump for delivering fuel to a fuel rail for distribution to a plurality of fuel injectors, fuel pump control means for controlling the speed of said pump, differential fuel pressure sensor means providing a pressure input to said control means representing the difference in pressure between engine intake manifold vacuum and the fuel pressure in said fuel rail, temperature sensor means for monitoring the temperature of the fuel in said fuel rail and providing a fuel temperature input to said control means, said control means including means for maintaining a substantially constant differential pressure by varying the pump speed to reduce any error between the output of said differential fuel pressure sensor means and a reference differential pressure, said control means including means for modifying said reference differential pressure as a function of said temperature input.

2. A returnless fuel delivery system comprising a variable speed motor driven fuel pump for delivering fuel to a plurality of fuel injectors, fuel pump control means for controlling the speed of said motor, differential fuel pressure sensor means providing a pressure input to said control means representing the difference in pressure between engine intake manifold vacuum and the pressure of the fuel supplied to said injectors, temperature sensor means for monitoring the temperature of the fuel supplied to said injectors and providing a fuel temperature input to said control means, said control means including means for maintaining a substantially constant differential pressure by varying the speed of said motor to reduce any error between the output of said differential fuel pressure sensor means and a reference differential pressure, said control means including means for modifying said reference differential pressure as a function of said temperature input.

3. The invention defined in claim 2 wherein the output of the pump is controlled by varying the duty cycle of a constant frequency pulse width modulated signal applied to said motor, said duty cycle comprised of two components which are combined to provide a value proportional to a desire duty cycle, one of said two component representing a projected duty cycle requirement necessary to maintain the present fuel mass flow demand for the engine, the other component representing a modification of said first component to compensate for any differential pressure error.

4. The invention defined in claim 3 wherein the present fuel mass flow demand is based on monitoring the period and pulse width of a signal controlling one of said injectors and wherein said modification is a function of the time history of the error.

5. The invention defined in claim 3 wherein a pressure relief valve is provided to prevent fuel supplied to the injectors from exceeding a predetermined level.

6. The invention defined in claim 3 wherein the pump is deenergized if the fuel mass flow demand of the engine is substantially less than the fuel mass being supplied by the pump.

7. In an engine fuel delivery system including a variable output fuel pump and fuel supply means for delivering fuel from the pump to the engine, a method of maintaining a desired mass fuel flow to the engine comprising the steps of:

(a) monitoring the fuel temperature and pressure of the fuel delivered to the engine, (b) determining the fuel mass flow demand of the engine in terms of pump output requirement to meet the demand, (c) modifying the pump output requirement determined in step (b) as a function of the time history of the difference between actual fuel pressure and a target fuel pressure, (d) varying the output of the pump as a function of the corrected pump output requirement determined in step (c) and, (e) modifying the target fuel pressure as a function of fuel temperature.

8. The method defined in claim 7 wherein the fuel pump is driven by a variable speed motor and the pump output is controlled by varying the duty cycle of a control signal applied to the motor.

9. The method of claim 7 comprising the further step of turning off the fuel pump when the fuel supplied to the engine is substantially greater than the fuel demand determined in step (b).

10. The method of claim 7 wherein the fuel mass flow demand determination of step (b) is responsive to the target pressure modification of step (e).

* * * * *